US009210744B2

(12) United States Patent
Del Carmen, Jr. et al.

(10) Patent No.: US 9,210,744 B2
(45) Date of Patent: Dec. 8, 2015

(54) BLEEDER CIRCUIT FOR USE IN A POWER SUPPLY

(75) Inventors: Jose Requinton Del Carmen, Jr., San Jose, CA (US); Christian Pura Angeles, San Jose, CA (US)

(73) Assignee: Power Integrations, Inc., San Jose, CA (US)

( * ) Notice: Subject to any disclaimer, the term of this patent is extended or adjusted under 35 U.S.C. 154(b) by 340 days.

(21) Appl. No.: 13/449,922

(22) Filed: Apr. 18, 2012

(65) Prior Publication Data

US 2013/0278159 A1 Oct. 24, 2013

(51) Int. Cl.
*H05B 37/02* (2006.01)
*H05B 33/08* (2006.01)

(52) U.S. Cl.
CPC ..... *H05B 33/0809* (2013.01); *H05B 33/0815* (2013.01); *H05B 33/0845* (2013.01)

(58) Field of Classification Search
USPC ..... 315/200 R, 209 SC, 291, 294, 297, 299, 315/306, 307, 124, 127, 224, 225
See application file for complete search history.

(56) References Cited

U.S. PATENT DOCUMENTS

| | | | | |
|---|---|---|---|---|
| 7,978,485 | B2 | 7/2011 | Stamm et al. | |
| 8,115,457 | B2 | 2/2012 | Balakrishnan et al. | |
| 8,264,165 | B2 * | 9/2012 | Gu et al. | 315/291 |
| 8,581,498 | B1 * | 11/2013 | Cheung et al. | 315/121 |
| 8,643,297 | B2 * | 2/2014 | Yang et al. | 315/219 |
| 8,692,479 | B2 | 4/2014 | Mercier et al. | |
| 2007/0024213 | A1 | 2/2007 | Shteynberg et al. | |
| 2007/0171698 | A1 | 7/2007 | Hoenigschmid et al. | |
| 2007/0285028 | A1 | 12/2007 | Tsinker et al. | |
| 2008/0143266 | A1 * | 6/2008 | Langer | 315/185 R |
| 2008/0224629 | A1 | 9/2008 | Melanson | |
| 2010/0207536 | A1 * | 8/2010 | Burdalski et al. | 315/224 |
| 2010/0301955 | A1 | 12/2010 | Luong et al. | |
| 2012/0056553 | A1 | 3/2012 | Koolen et al. | |
| 2012/0126714 | A1 * | 5/2012 | Deppe et al. | 315/192 |

(Continued)

FOREIGN PATENT DOCUMENTS

| | | | |
|---|---|---|---|
| CN | 102148564 | A | 8/2011 |
| WO | WO 2011/045057 | A1 | 4/2011 |

OTHER PUBLICATIONS

Hall et al., Frequency Spectrum Generated by Thyristor Control, Electrocomponent Science and Technology, 1974, vol. 1, pp. 43-49.*

(Continued)

*Primary Examiner* — Douglas W Owens
*Assistant Examiner* — James H Cho
(74) *Attorney, Agent, or Firm* — Blakely Sokoloff Taylor & Zafman LLP

(57) ABSTRACT

A bleeder circuit for use in a power supply of a lighting system includes a first terminal to be coupled to a first input of the power supply. A second terminal is to be coupled to a second input of the power supply. An edge detection circuit is coupled between the first and second terminals of the bleeder circuit. The edge detection circuit is coupled to output an edge detection signal in response to an input signal between the first and second inputs. A variable current circuit is coupled to the edge detection circuit and coupled between the first and second terminals of the bleeder circuit. The variable current circuit is coupled to conduct a bleeder current between the first and second terminals of the bleeder circuit in response to the edge detection signal.

25 Claims, 9 Drawing Sheets

(56) References Cited

U.S. PATENT DOCUMENTS

| | | | |
|---|---|---|---|
| 2012/0286663 | A1 | 11/2012 | Puvanakijjakorn et al. |
| 2013/0169177 | A1 | 7/2013 | Liao et al. |
| 2014/0042922 | A1 | 2/2014 | Wu et al. |

OTHER PUBLICATIONS

"AN2711—Application Note: 15 W Offline TRIAC Dimmable LED Driver," STMicroelectronics, Doc. ID 14425, Rev. 2, Apr. 2009 (33 pages).

"AN-9745: Design Guide for TRIAC Dimmable LED Driver Using FL7730," Fairchild Semiconductor, Rev. 1.0.1, Oct. 31, 2011 (11 pages).

U.S. Appl. No. 13/777,924—Ex Parte Quayle Office Action, mailed Jun. 27, 2014, 5 pages.

CN Patent Application No. 201310136140.7—Chinese Office Action, with English Translation, and Search Report, issued Oct. 30, 2014 (11 pages).

* cited by examiner

BLEEDER CIRCUIT FOR USE IN A POWER SUPPLY

BACKGROUND INFORMATION

1. Field of the Disclosure

The present invention relates generally to power supplies. More specifically, examples of the present invention are related to lighting systems including dimming circuitry for use with power supplies.

2. Background

Electronic devices use power to operate. Power is generally delivered through a wall socket as high voltage alternating current (ac). A device, typically referred to as a power converter or as a power supply, can be utilized in lighting systems to transform the high voltage ac input into a well regulated direct current (dc) output through an energy transfer element. Switched mode power converters are commonly used due to their high efficiency, small size, and low weight to power many of today's electronics. During operation, a switch included in a driver circuit of the power converter is utilized to provide the desired output by varying the duty cycle (typically the ratio of the on time of the switch to the total switching period), varying the switching frequency or varying the number of pulses per unit time of the switch in a power converter.

In one type of dimming for lighting applications, a TRIAC dimmer circuit removes a portion of the ac input voltage to limit the amount of voltage and current supplied to an incandescent lamp. This is known as phase dimming because it is often convenient to designate the position of the missing voltage in terms of a fraction of the period of the ac input voltage measured in degrees. In general, the ac input voltage is a sinusoidal waveform and the period of the ac input voltage is referred to as a full line cycle. As such, half the period of the ac input voltage is referred to as a half line cycle. An entire period has 360 degrees, and a half line cycle has 180 degrees. Typically, the phase angle is a measure of how many degrees (from a reference of zero degrees) of each half line cycle the dimmer circuit removes. As such, removal of half the ac input voltage in a half line cycle by the TRIAC dimmer circuit corresponds to a phase angle of 90 degrees. In another example, removal of a quarter of the ac input voltage in a half line cycle may correspond to a phase angle of 45 degrees.

Although phase angle dimming works well with incandescent lamps that receive the altered ac line voltage directly, it typically creates problems for light emitting diode (LED) lamps driven by a switched mode power converter. Conventional regulated switched mode power converters are typically designed to ignore distortions of the ac input voltage and deliver a constant regulated output until a low input voltage causes them to shut off. As such, conventional regulated switched mode power converters cannot dim LED lamps. Unless a power converter for an LED lamp is specially designed to recognize and respond to the voltage from a TRIAC dimmer circuit in a desirable way, a TRIAC dimmer can produce unacceptable results such as flickering of the LED lamp.

Another difficulty in using TRIAC dimming circuits with LED lamps comes from a characteristic of the TRIAC itself. A TRIAC is a semiconductor component that behaves as a controlled ac switch. In other words, it behaves as an open switch to an ac voltage until it receives a trigger signal at a control terminal, which causes the switch to close. The switch remains closed as long as the current through the switch is above a value referred to as the holding current. Most incandescent lamps use more than enough current from the ac power source to allow reliable and consistent operation of a TRIAC. However, the low current used by efficient power converters to drive LED lamps may not provide enough current to keep a TRIAC conducting for the expected portion of the ac line period.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
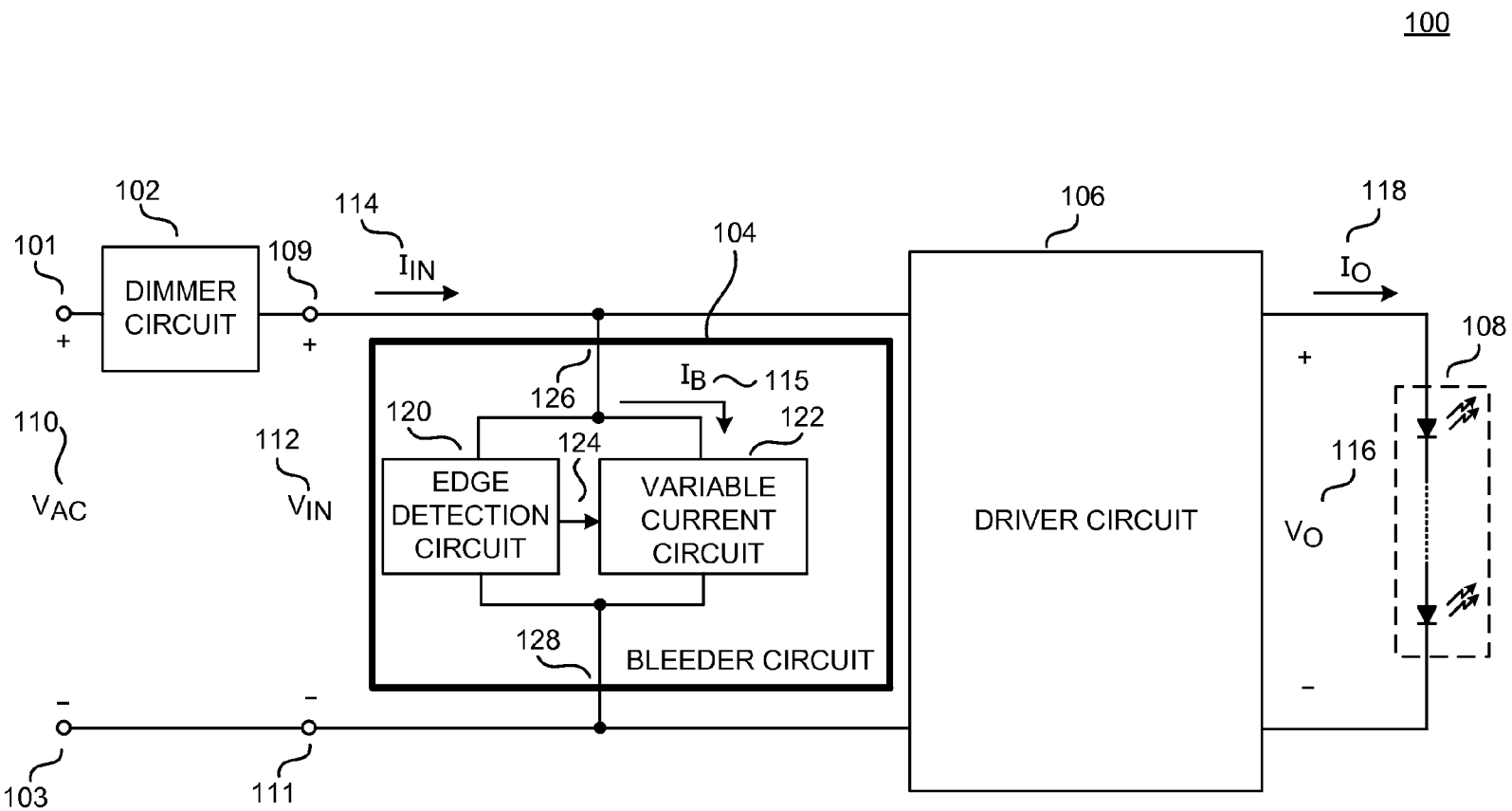
FIG. 1 is a functional block diagram of one example of a power supply included in a lighting system including an example bleeder circuit in accordance with the teachings of the present invention.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention.

DETAILED DESCRIPTION

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or subcombinations in one or more embodiments or examples. Particular features, structures or characteristics may be included in an integrated circuit, an electronic circuit, a combinational logic circuit, or other suitable components that provide the described functionality. In addition, it is appreciated that the figures provided herewith are for explanation purposes to persons ordinarily skilled in the art and that the drawings are not necessarily drawn to scale.

As mentioned above, a TRIAC dimmer circuit is one example of a dimming circuit included in power supplies utilized in lighting applications, which removes a portion of the ac input voltage to limit the amount of voltage and current supplied to an incandescent lamp. This is known as phase dimming because it is often convenient to designate the position of the missing voltage in terms of a fraction of the period of the ac input voltage measured in degrees. Although phase angle dimming works well with incandescent lamps that receive the altered ac line voltage directly, it typically creates problems for light emitting diode (LED) lamps driven by a switching power converter. Unless a power converter for an LED lamp is specially designed to recognize and respond to the voltage from a TRIAC dimmer circuit in a desirable way, a TRIAC dimmer can produce unacceptable results such as flickering of the LED lamp.

Another difficulty in using TRIAC dimming circuits with LED lamps comes from a characteristic of the TRIAC itself. A TRIAC is a semiconductor component that behaves as a controlled ac switch. In other words, it behaves as an open switch to an ac voltage until it receives a trigger signal at a control terminal which causes the switch to close. The TRIAC begins conducting when the current through the switch is above a value referred to as the latching current. The switch remains closed as long as the current through the switch is above a value referred to as the holding current. Most incandescent lamps take more than enough current from the ac power source to allow reliable and consistent operation of a TRIAC. However, the low current taken by efficient power converters which drive LED lamps from the ac power source may not be enough to keep a TRIAC conducting for the expected portion of the ac line period. Further, the high frequency transition of the sharply increasing input voltage when the TRIAC fires during each half line cycle causes inrush input current ringing which may reverse several times during the half line cycle. During these current reversals, the TRIAC may prematurely turn off and cause flickering in the LED lamp. Therefore, power converter controller designs usually rely on the power converter including a dummy load, sometimes called a bleeder circuit, to take enough extra current from the input of the power converter to keep the TRIAC conducting. In addition, the bleeder circuit may be utilized to keep the current through the TRIAC above the holding current.

Conventional bleeder circuits may include a series damping resistor, which is coupled between the TRIAC and the input of the power converter. However, the series damping resistor conducts (and therefore dissipates power) while a voltage is present. As such, use of a series damping resistor affects the efficiency of the overall power conversion system.

Accordingly, examples of power supplies used in lighting systems with dimming circuitry include bleeder circuits that utilize various examples of edge detection circuits and variable current circuits in accordance with the teachings of the present invention. As will be shown, an example edge detection circuit includes a high pass filter that senses high frequency transitions in an input signal to determine when there is an edge in the input signal of the power supply. A high frequency transition indicates when the dimmer circuit has fired. The edge detection circuit provides an edge detection signal to the variable current circuit. Once the edge detection signal indicates that dimmer circuit has fired by sensing the high frequency transition, the variable current circuit conducts a bleeder current, which provides enough current to keep the dimmer circuit conducting. In the examples, the variable current circuit continues conducting the bleeder current until the end of the half line cycle or until the output of the dimmer circuit has fallen to zero. In the examples, the bleeder circuit does not conduct any bleeder current until an edge has been sensed in the input signal. As such, during normal operation of the power supply of the lighting system, there is no loss in efficiency due to the bleeder circuit in accordance with the teachings of the present invention.

To illustrate, FIG. 1 is a functional block diagram of one example of a power supply 100 of a lighting system including an example bleeder circuit 104 in accordance with the teachings of the present invention. As shown in the depicted example, power supply 100 includes a driver circuit 106 that is coupled to drive a load 108 with an output voltage $V_O$ 116 and an output current $I_O$ 118. In one example, driver circuit 106 includes a switched mode power converter and load 108 includes one or more light emitting diode (LED) lamps. Power supply 100 includes a first input 109 and a second input 111 that are coupled to receive an input signal $V_{IN}$ 112. In one example, input signal $V_{IN}$ 112 is to be received from a dimmer circuit 102, which is coupled to receive an ac line voltage $V_{AC}$ 110 between terminals 101 and 103. Dimmer circuit 102 may be external to power supply 100. As shown in the depicted example, driver circuit 106 is coupled to receive the input signal $V_{IN}$ 112 and input current $I_{IN}$ 114. In one example, dimmer circuit 102 to be coupled to first input 109 of power supply 100 includes a thyristor dimmer circuit, which adds high frequency transitions to input signal $V_{IN}$ 112 by removing portions of the ac line voltage $V_{AC}$ 110 to limit the amount of voltage and current supplied by input signal $V_{IN}$ 112 and input current $I_{IN}$ 114, respectively. In a further example, dimmer circuit 102 may include a TRIAC dimmer circuit.

As shown in the depicted example, power supply 100 also includes bleeder circuit 104, which includes a first terminal 126 to be coupled to a first input 109 of power supply 100. In one example, bleeder circuit 104 is an active bleeder circuit in accordance with the teachings of the present invention. Bleeder circuit 104 also includes a second terminal 128 to be coupled to a second input 111 of power supply 100. Bleeder circuit 104 may be implemented as a monolithic integrated circuit or may be implemented with discrete electrical components or a combination of discrete and integrated components.

An edge detection circuit 120 is coupled between first and second terminals 126 and 128 of bleeder circuit 104. In one example, edge detection circuit 120 is coupled to output an edge detection signal 124 in response to a high frequency transition sensed in input signal $V_{IN}$ 112. As shown in the illustrated example, a variable current circuit 122 is coupled to edge detection circuit 120 and coupled between first and second terminals 126 and 128 of bleeder circuit 104. Variable current circuit 122 is coupled to conduct a bleeder current $I_B$ 115 between first and second terminals 126 and 128 of bleeder circuit 104 in response to the edge detection signal 124 in accordance with the teachings of the present invention. With bleeder current $I_B$ 115, a sufficient holding current is provided with input current $I_{IN}$ 114 to prevent a switch in dimmer circuit 102 from opening prematurely, which helps to prevent unwanted flickering in an LED lamp driven by driver circuit 106 in accordance with the teachings of the present invention. Further, the bleeder circuit 104 provides a sufficient latching current for the dimmer circuit 102.

Figure 2A:
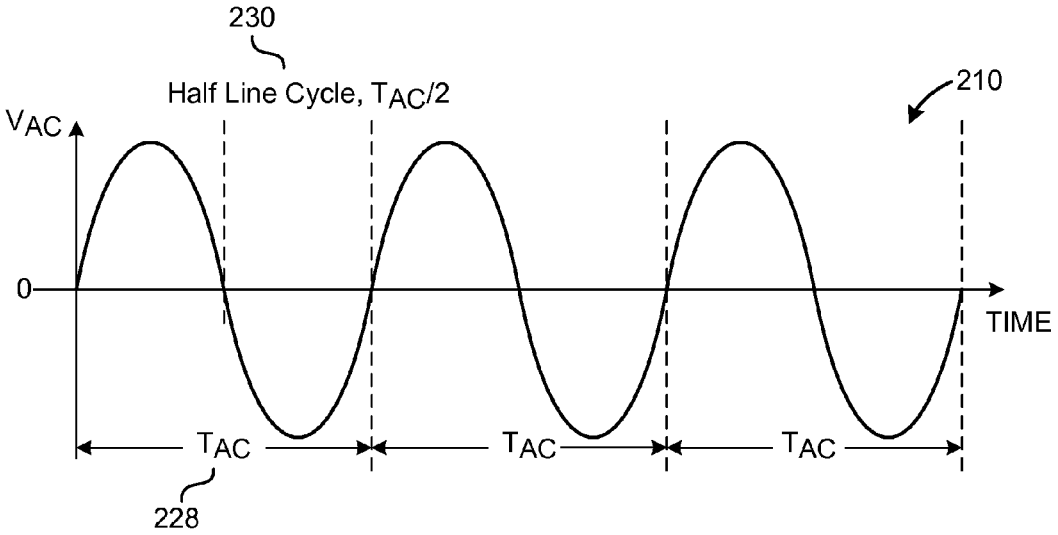
FIG. 2A illustrates an example of an ac input voltage waveform received by an example power supply of a lighting system in accordance with the teachings of the present invention.
Figure 2B:
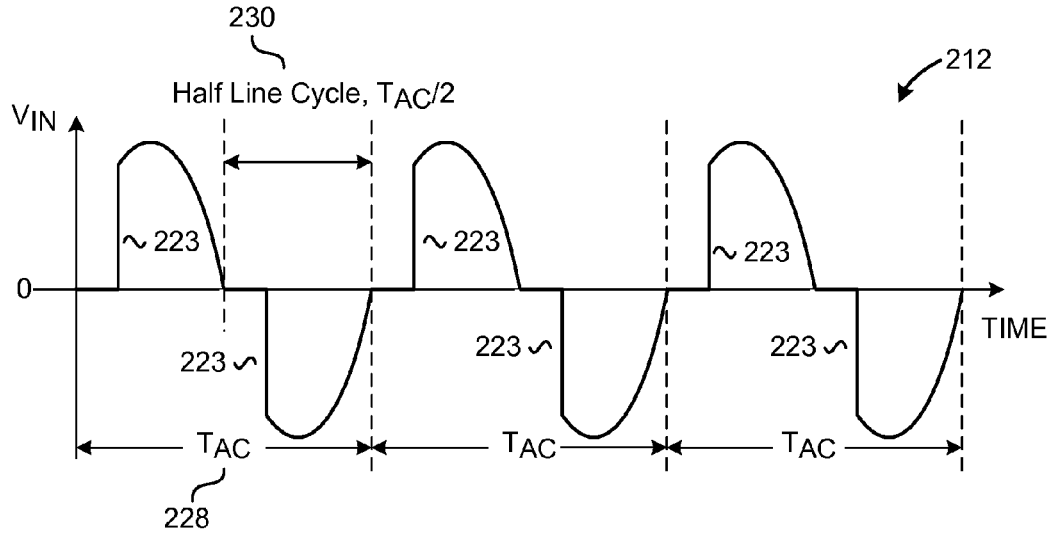
FIG. 2B illustrates an example input signal waveform received by an example power supply of a lighting system through a dimmer circuit in accordance with the teachings of the present invention.

Referring now to FIGS. 2A and 2B, FIG. 2A illustrates an example of an ac line voltage $V_{AC}$ 210 waveform received by a dimmer circuit, which is coupled to provide an input signal $V_{IN}$ 212 to an example power supply of a lighting system in accordance with the teachings of the present invention. FIG. 2B illustrates an example of an input signal $V_{IN}$ 212 waveform received by an example power supply of a lighting system from a dimmer circuit, such as for example a TRIAC dimmer, in accordance with the teachings of the present invention. As shown in the depicted example, ac line voltage $V_{AC}$ 210 is an ac input voltage and therefore a sinusoidal waveform with a line cycle period 228. The line cycle period 228 of the ac line voltage $V_{AC}$ 210 may also be referred to as a full line cycle period. FIG. 2A also shows a half line cycle 230, which is half of line cycle period 228. As shown in the depicted example, half line cycle 230 is the length of time between zero crossings of ac line voltage $V_{AC}$ 210.

Referring briefly now back to FIG. 1, dimmer circuit 102 disconnects and reconnects the ac line voltage $V_{AC}$ 110 from the first input 109 and driver circuit 106. When the ac line voltage $V_{AC}$ 110 crosses zero voltage, dimmer circuit 102 disconnects the ac line voltage $V_{AC}$ 110 from first input 109. As such the ac line voltage $V_{AC}$ 110 is disconnected from the driver circuit 106 and bleeder circuit 104. After a given amount of time, dimmer circuit 102 reconnects ac line voltage $V_{AC}$ 110 to first input 109 and to bleeder circuit 104 and driver circuit 106. Referring now to FIGS. 1 and 2B, the dimmer circuit 102 removes a portion of each half line cycle 230 of ac line voltage $V_{AC}$ 210 to provide the voltage waveform shown as input signal $V_{IN}$ 212, thus limiting the amount of voltage and current supplied to load 108 by driver circuit 106. As shown in FIG. 2B, the voltage of input signal $V_{IN}$ 212 is substantially zero when the dimmer circuit 102 has disconnected the ac line voltage $V_{AC}$ 210 from first input 109. The voltage waveform of input signal $V_{IN}$ 212 substantially follows the ac line voltage $V_{AC}$ 210 when the dimmer circuit 102 reconnects the ac line voltage $V_{AC}$ 210 to first input 109. FIG. 2B illustrates the edges 223 in input signal $V_{IN}$ 212 during each half line cycle 230 resulting from the high frequency transitions 223 caused by dimmer circuit 102 disconnecting and reconnecting ac line voltage $V_{AC}$ 210 as discussed.

The amount of desired dimming corresponds to the length of time during which the dimmer circuit 102 disconnects the ac line voltage $V_{AC}$ 210 from first input 109. It is noted that dimmer circuit 102 also includes an input (not shown), which provides dimmer circuit 102 with information regarding the amount of desired dimming. The longer dimmer circuit 102 disconnects the ac line voltage $V_{AC}$ 210 from the power supply, the longer the voltage of input signal $V_{IN}$ 212 is substantially equal to zero voltage.

Figure 3A:
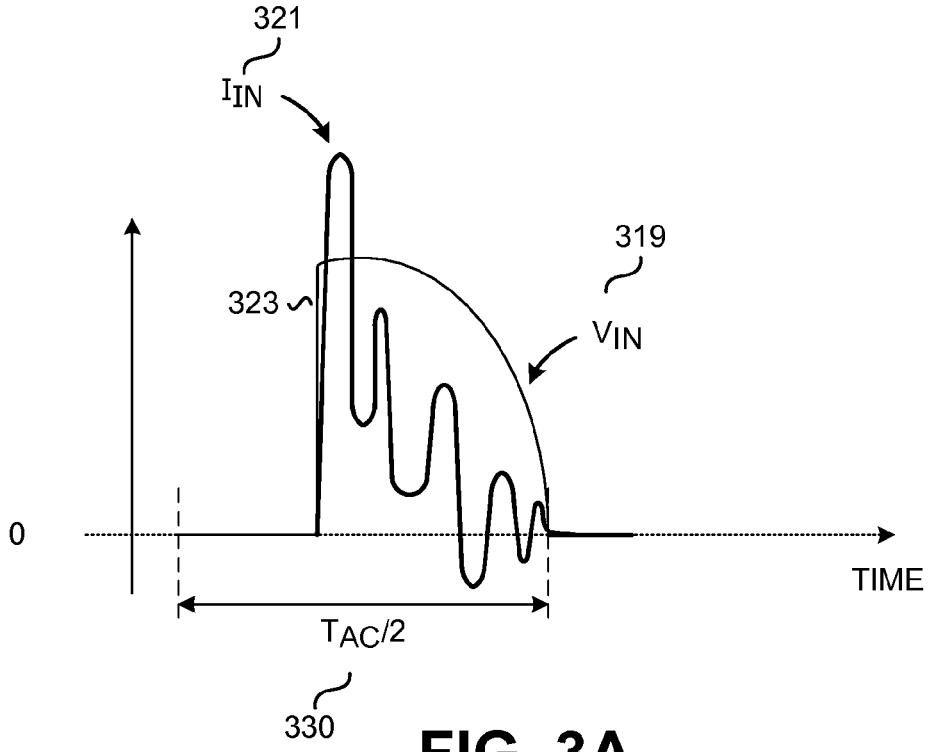
FIG. 3A illustrates example voltage and current waveform of an input signal of a power supply of a lighting system.
Figure 3B:
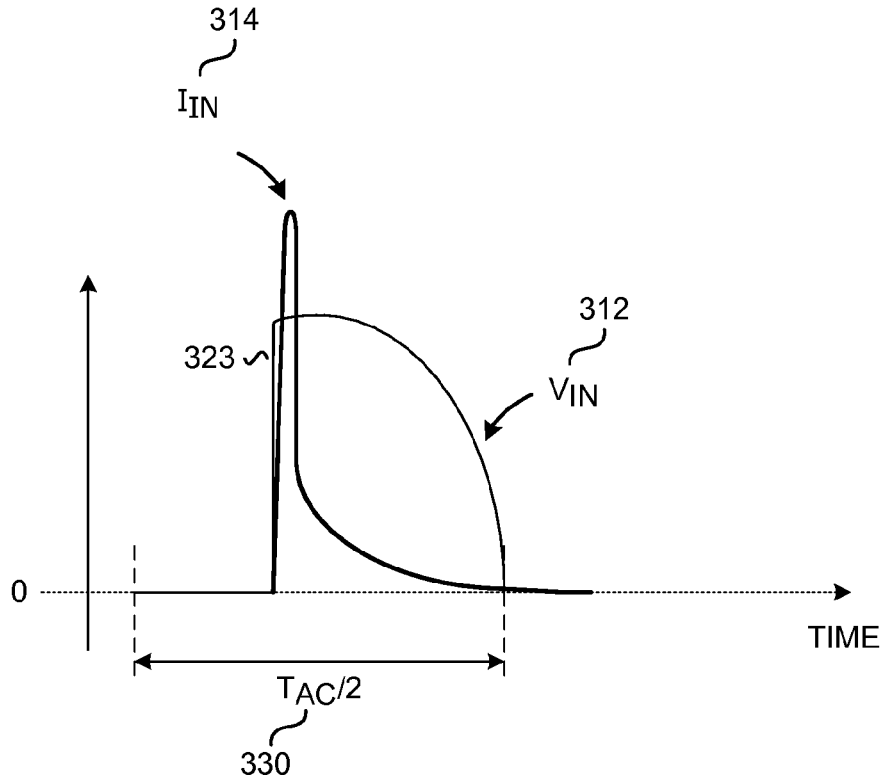
FIG. 3B illustrates example voltage and current waveforms of an input signal received by a power supply of a lighting system in accordance with the teachings of the present invention.

Referring next to FIGS. 3A and 3B, FIG. 3A illustrates example input signal $V_{IN}$ 319 waveform and input current $I_{IN}$ 321 waveform of an input signal of a power supply of a lighting system. FIG. 3B illustrates example an input signal $V_{IN}$ 312 waveform and input current $I_{IN}$ 314 waveform received by a power supply of a lighting system in accordance with the teachings of the present invention. In particular, FIG. 3A shows an example input signal $V_{IN}$ 319 waveform and input current $I_{IN}$ 321 waveform for one half line cycle 330 as output by a dimmer circuit, such as for example dimmer circuit 102. In the example depicted in FIG. 3A, input signal $V_{IN}$ 319 waveform and input current $I_{IN}$ 321 waveform are received by driver circuit 106 when bleeder circuit 104 is not included in power supply 100. FIG. 3B illustrates an example of input signal $V_{IN}$ 312 waveform and input current $I_{IN}$ 314 waveform are received by driver circuit 106 when bleeder circuit 104 is included in power supply 100 in accordance with the teachings of the present invention.

As discussed above, the voltage of input signal $V_{IN}$ 319 shown in FIG. 3A is substantially zero at the beginning of half line cycle 330. When the dimmer circuit 102 reconnects the ac line voltage $V_{AC}$ 110, the voltage of input signal $V_{IN}$ 319 increases quickly at high frequency transition 323 and substantially follows the voltage of ac line voltage $V_{AC}$ 110 for the remainder of the half line cycle 330. At the beginning of the half line cycle 330, the input current $I_{IN}$ 321 is also substantially zero until the dimmer circuit 102 fires. Once the dimmer circuit 102 fires, the input current $I_{IN}$ 321 also increases quickly such that there is also a high frequency transition 323 of input current $I_{IN}$ 321. As shown in FIG. 3A, without the inclusion of bleeder circuit 104, the input current $I_{IN}$ 321 rings. This is partially due to an input capacitor included within the driver circuit 106 and other inductive and capacitive elements included within driver circuit 106. As illustrated in FIG. 3A, the input current $I_{IN}$ 321 may reverse polarity several times during the half line cycle 330 as a consequence of the ringing. If the input current $I_{IN}$ 321 falls below the holding current of the dimmer circuit 102 before the end of the half line cycle 330, or before the input signal $V_{IN}$ 319 has reached zero, the dimmer circuit 102 may prematurely turn off and cause flickering in the load 108 driven by driver circuit 106.

However, examples in accordance with teachings of the present invention may reduce the ringing of the dimmer current, as shown by input current $I_{IN}$ 314 in FIG. 3B. Similar to the discussion above in connection with FIG. 2B, the voltage of input signal $V_{IN}$ 312 is substantially zero until the dimmer circuit 102 fires and the voltage of input signal $V_{IN}$ 312 increases at high frequency transition 323 and substantially follows the voltage of ac line voltage $V_{AC}$ 110. The input current $I_{IN}$ 314 is also substantially zero until the dimmer circuit 102 reconnects the ac line voltage $V_{AC}$ 110. Once the dimmer circuit 102 reconnects the ac line voltage $V_{AC}$ 110, the input current $I_{IN}$ 314 also increases quickly at high frequency transition 323. However, as shown in FIG. 3B, the inclusion of bleeder circuit 104 reduces the ringing and helps to prevent the input current $I_{IN}$ 314 from falling below the holding current of the dimmer circuit 102 or falling below zero. Further, inclusion of bleeder circuit 104 provides sufficient latching current.

Therefore, referring briefly back to the example depicted in FIG. 1, the inclusion of bleeder circuit 104 provides bleeder current $I_B$ 115 in response to a high frequency transition in the input signal $V_{IN}$ 112 and/or a high frequency transition in input current $I_{IN}$ 114, which helps to prevent the input current $I_{IN}$ 114 from falling below the holding current. As will be further discussed, the peak value of input current $I_{IN}$ 114 and the length of time which the input current $I_{IN}$ 114 decays may be partially determined by the characteristic of the bleeder circuit 104 in accordance with the teachings of the present invention.

Figure 4:
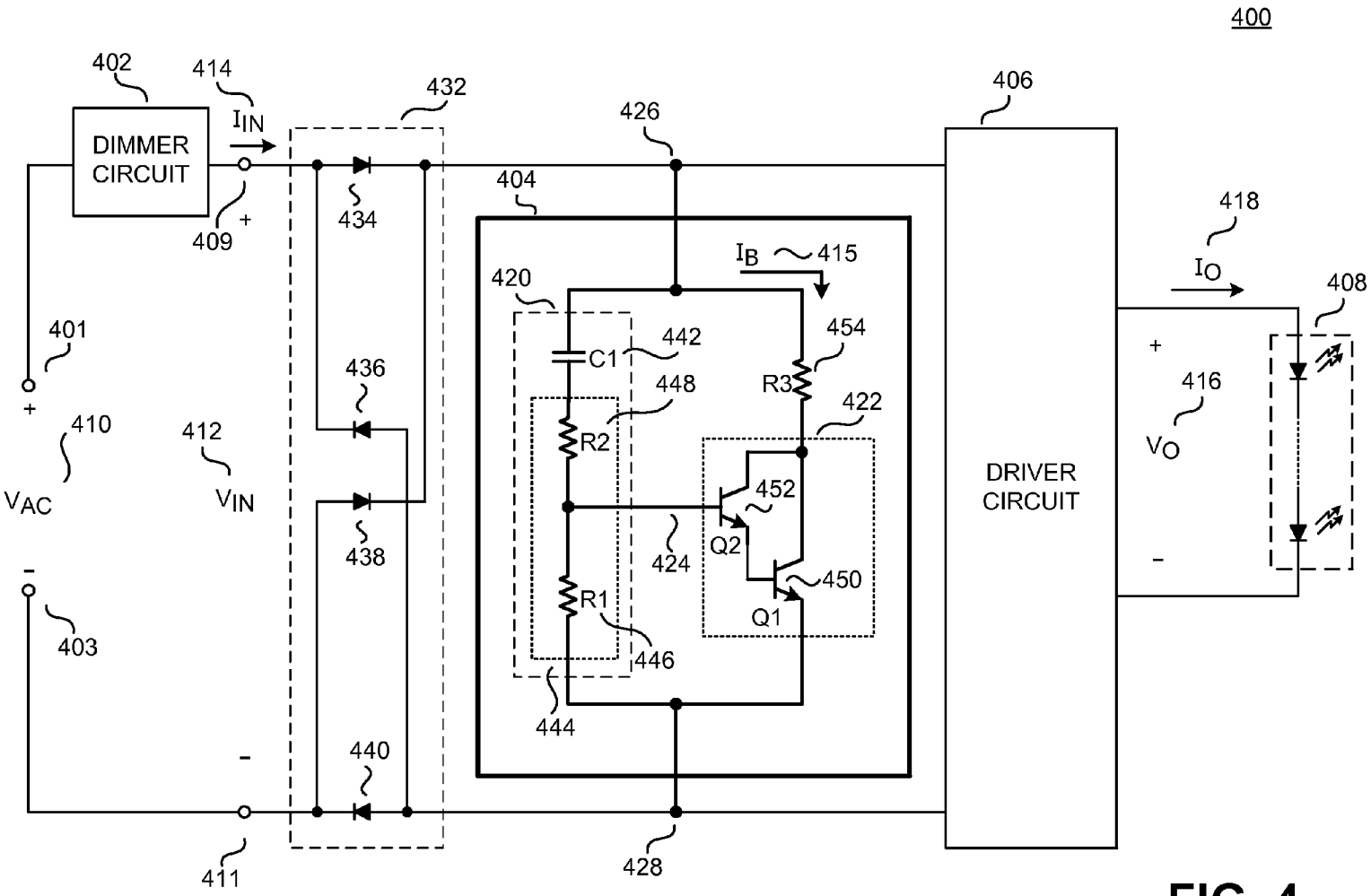
FIG. 4 is a functional block diagram of an example of a power supply included in a lighting system including another example bleeder circuit in accordance with the teachings of the present invention.

FIG. 4 is a functional block diagram of an example of a power supply 400 included in a lighting system including another example bleeder circuit 404 in accordance with the teachings of the present invention. As shown, power supply 400 includes a driver circuit 406 that is coupled to drive a load 408 with an output voltage $V_O$ 416 and an output current $I_O$ 418. In one example, driver circuit 406 includes a switched mode power converter and load 408 includes one or more light emitting diode (LED) lamps. Power supply 400 includes a first input 409 and a second input 411 that are coupled to receive an input signal $V_{IN}$ 412. In one example, input signal $V_{IN}$ 412 is to be received from a dimmer circuit 402, which is coupled to receive an ac line voltage $V_{AC}$ 410 between terminals 401 and 403. Dimmer circuit 402 may be external to power supply 400. As shown in the depicted example, driver circuit 406 is coupled to receive the input signal $V_{IN}$ 412 and input current $I_{IN}$ 414. In one example, dimmer circuit 402 includes a thyristor dimmer circuit, which removes portions of the ac line voltage $V_{AC}$ 410 to limit the amount of voltage and current supplied in input voltage $V_{IN}$ 412 and input current $I_{IN}$ 414, respectively. In the depicted example, a rectifier 432 is also included between the inputs 409 and 411 of power supply 400. In one example, rectifier 432 includes diode 434, diode 436, diode 438 and diode 440 coupled as shown to provide full wave rectification of input signal $V_{IN}$ 412.

As shown in the depicted example, power supply 400 also includes bleeder circuit 404, which includes a first terminal 426 to be coupled to a first input 409 of power supply 400. In one example, bleeder circuit 404 is an active bleeder circuit in accordance with the teachings of the present invention. Bleeder circuit 404 also includes a second terminal 428 to be coupled to a second input 411 of power supply 400. Bleeder circuit 404 may be implemented as a monolithic integrated circuit or may be implemented with discrete electrical components or a combination of discrete and integrated components. An edge detection circuit 420 is coupled between first and second terminals 426 and 428 of bleeder circuit 404. In one example, edge detection circuit 420 is coupled to output an edge detection signal 424 in response to a high frequency transition sensed in input signal $V_{IN}$ 412. As shown in the illustrated example, a variable current circuit 422 is coupled to edge detection circuit 420 and coupled between first and second terminals 426 and 428 of bleeder circuit 404. Variable current circuit 422 is coupled to conduct a bleeder current $I_B$ 415 between first and second terminals 426 and 428 of bleeder circuit 404 in response to the edge detection signal 424 in accordance with the teachings of the present invention. With bleeder current $I_B$ 415, a sufficient holding current is provided with input current $I_{IN}$ 414 to prevent a switch in dimmer circuit 402 from turning off prematurely, which prevents unwanted flickering in an LED lamp driven by driver circuit 406 in accordance with the teachings of the present invention.

In one example, edge detection circuit 420 includes a high pass filter coupled between the first and second terminals 426 and 428 of the bleeder circuit 404. The high pass filter 420 includes an output coupled to generate the edge detection signal 424 in response to a high frequency transition in the input signal $V_{IN}$ 412 between the first and second inputs 409 and 411 of the power supply 400. In the example depicted in FIG. 4, the edge detection circuit 420 includes a capacitance 442 and a resistance 444 coupled between the first and second terminals 426 and 428 of the bleeder circuit 404. Therefore, in one example, high pass filter 420 is an RC filter having characteristics determined by the capacitance of capacitance 442 and the resistance of resistance 444. In the depicted example, the edge detection signal 424 is output from the resistance 444. In one example, the resistance 444 includes a resistor divider including a first resistor R1 446 and a second resistor R2 448 coupled between the capacitance 442 and the second terminal 428. In the example, the edge detection signal 424 is output from a node between the first resistor R1 446 and the second resistor R2 448.

In one example, variable current circuit 422 includes a current amplifier circuit having an input coupled to receive the edge detection signal 424 to conduct bleeder current $I_B$ 415 between first terminal 426 and second terminal 428 in accordance with the teachings of the present invention. Variable current circuit 422 is coupled between the first and second terminals 426 and 428 to conduct the bleeder current $I_B$ 415 in response to the edge detection signal 424 in accordance with the teachings of the present invention. In one example, a third resistor R3 454 is included and is coupled to the variable current circuit 422 and coupled between the first and second terminals 426 and 428 of the bleeder circuit 404 as shown. In the example illustrated in FIG. 4, third resistor R3 454 is coupled between first terminal 426 and variable current circuit 422.

In one example, variable current circuit 422 includes a first transistor Q1 450 having a first terminal coupled to the first terminal 426 of the bleeder circuit 404, a second terminal coupled to the second terminal 428 of the bleeder circuit 404, and a control terminal coupled to be responsive to the edge detection signal 424. In one example, variable current circuit 422 also includes a second transistor Q2 452 having a first terminal coupled to the first terminal of the first transistor Q1 450, a second terminal coupled to the control terminal of the first transistor Q1 450, and a control terminal coupled to receive the edge detection signal 424 from the edge detection circuit 420. As shown in the example depicted in FIG. 4, the first and second transistors Q1 450 and Q2 452 are bipolar transistors, which provide a Darlington pair coupled between the first and second terminals 426 and 428 and coupled to be responsive to the edge detection signal 424. FIG. 4 illustrates NPN bipolar transistors however PNP transistors may also be utilized. It should be appreciated that other transistors may be utilized, such as metal-oxide-semiconductor field-effect transistors (MOSFETs), junction gate field-effect transistors (JFETs), or insulated gate bipolar transistors (IGBTs).

In one example, first and second transistors Q1 450 and Q2 452 can be operated in either the active or saturation region. In an example in which first and second transistors Q1 450 and Q2 452 are operated in the active region, the third resistor R3 is optional. Therefore, in one example in which edge detection signal 424 is a current and in which variable current circuit 422 includes the Darlington pair of first and second transistors Q1 450 and Q2 452 operating in the active region, the bleeder current $I_B$ 415 is an amplified representation of the current of edge detection signal 424. The bleeder current $I_B$ 415 is substantially equal to the current provided by the edge detection signal 424 multiplied by both the beta of first transistor Q1 450 and the beta of second transistor Q2 452 in accordance with the teachings of the present invention. Partially due to the variable current circuit 422, a smaller capacitance may be utilized for C1 442. A smaller capacitance may translate to savings in both cost and area of the power converter over previous solutions.

In another example in which first and second transistors Q1 450 and Q2 452 are operated in the saturation region, third resistor R3 454 is included, and the magnitude of bleeder current $I_B$ 415 is determined in response to the resistance value of third resistor R3 454. Therefore, in the example depicted in FIG. 4 in which first and second transistors Q1 450 and Q2 452 are operated in the saturation region, the variable current circuit 422 functions as a switch with the magnitude of bleeder current $I_B$ 415 is determined by the resistance value of third resistor R3 454.

Referring briefly back to FIG. 3B, the values selected for the capacitance C1 442 and resistance 444 may partially determine the peak value of input current $I_{IN}$ 314 and the length of time which the input current $I_{IN}$ 314 decays. In particular the equivalent impedance of capacitance C1 442 and R2 448 may determine the peak value of the input current $I_{IN}$ 314 while the time constant set by capacitance C1 442 and resistance 444 may determine the length of time input current $I_{IN}$ 314 decays to zero. Further, the values selected for capacitance C1 442 and resistance 444 may determine at what frequency the edge detector 420 responds.

Figure 5:
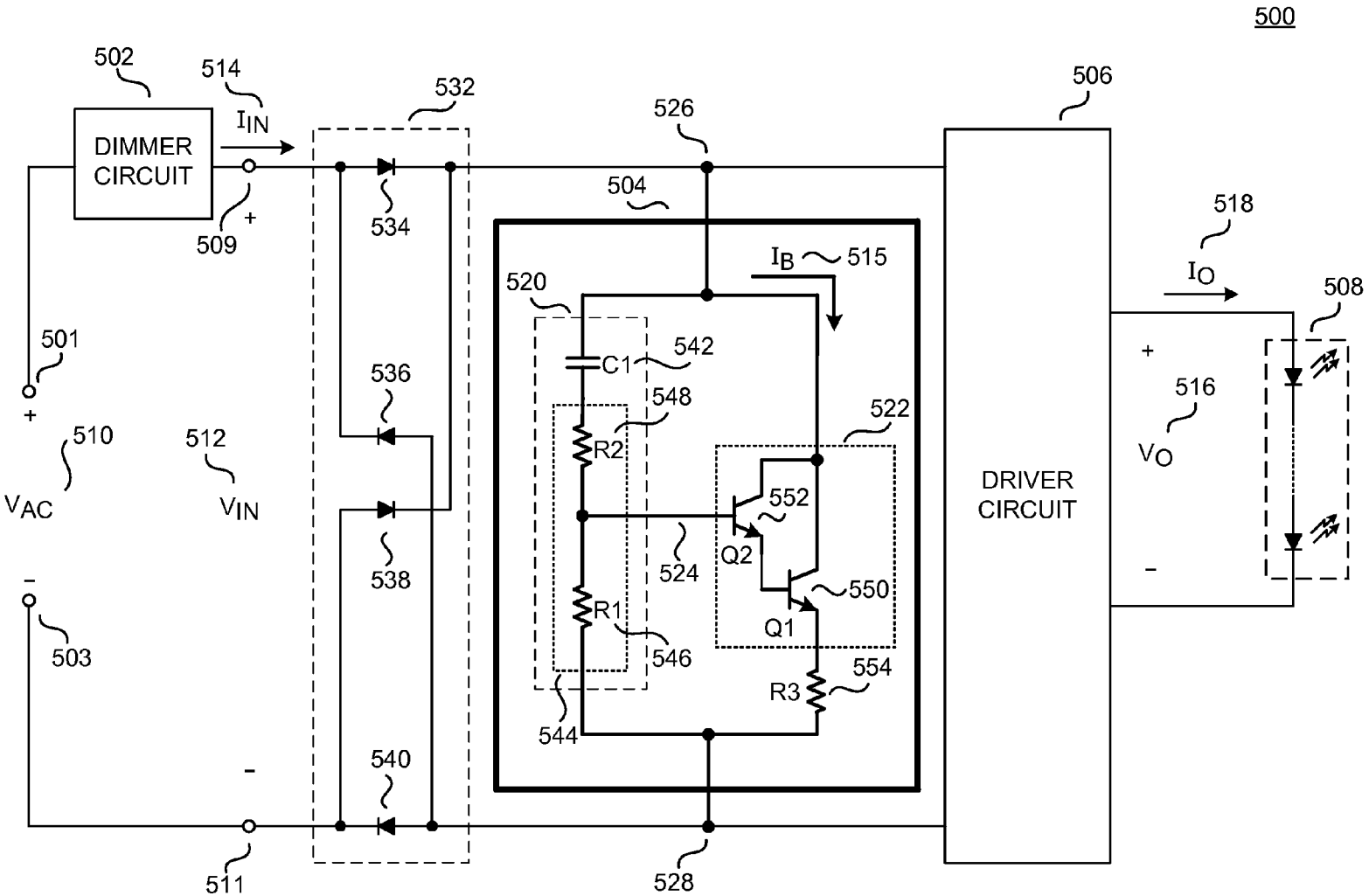
FIG. 5 is a functional block diagram of an example of a power supply included in a lighting system including yet another example bleeder circuit in accordance with the teachings of the present invention.

FIG. 5 is a functional block diagram of an example of a power supply 500 included in a lighting system including yet another example bleeder circuit 504 in accordance with the teachings of the present invention. It is appreciated that example power supply 500 of FIG. 5 shares many similarities with power supply 400 of FIG. 4. For instance, power supply 500 includes a driver circuit 506 that is coupled to drive a load 508 with an output voltage $V_O$ 516 and an output current $I_O$ 518. In the depicted example, driver circuit 506 is coupled to receive the input signal $V_{IN}$ 512 and input current $I_{IN}$ 514 from first input 509 and second input 511. In the depicted example, a rectifier 532 is also included between first input 509 and second input 511. As shown, rectifier 532 includes diode 534, diode 536, diode 538 and diode 540 coupled as shown to provide full wave rectification of input signal $V_{IN}$ 512. Dimmer circuit 402 may be external to power supply 400.

As shown in the depicted example, power supply 500 also includes bleeder circuit 504, which includes a first terminal 526 to be coupled to a first input 509 of power supply 500. Bleeder circuit 504 also includes a second terminal 528 to be coupled to a second input 511 of power supply 500. Bleeder circuit 504 may be implemented as a monolithic integrated circuit or may be implemented with discrete electrical components or a combination of discrete and integrated components. An edge detection circuit 520 is coupled between first and second terminals 526 and 528 of bleeder circuit 504. In one example, edge detection circuit 520 is coupled to output an edge detection signal 524 in response to a high frequency transition sensed in input signal $V_{IN}$ 512. A variable current circuit 522 is coupled to edge detection circuit 520 and coupled between first and second terminals 526 and 528 of bleeder circuit 504. Variable current circuit 522 is coupled to conduct a bleeder current $I_B$ 515 between first and second terminals 526 and 528 of bleeder circuit 504 in response to the edge detection signal 524 in accordance with the teachings of the present invention.

In one example, edge detection circuit 520 includes a high pass filter coupled between the first and second terminals 526 and 528 of the bleeder circuit 504. In the example depicted in FIG. 5, the edge detection circuit 520 includes a capacitance 542 and a resistance 544 coupled between the first and second terminals 526 and 528 of the bleeder circuit 504. In one example, the resistance 544 includes a resistor divider including a first resistor R1 546 and a second resistor R2 548 coupled between the capacitance 542 and the second terminal 528. In the example, the edge detection signal 524 is output from a node between the first resistor R1 546 and the second resistor R2 548.

In one example, variable current circuit 522 includes a current amplifier circuit having an input coupled to receive the edge detection signal 524 to conduct bleeder current $I_B$ 515 between first terminal 526 and second terminal 528 in accordance with the teachings of the present invention. In one example, a third resistor R3 554 is included and is coupled to the variable current circuit 522 and coupled between the first and second terminals 526 and 528 of the bleeder circuit 504 as shown.

One difference between power supply 500 of FIG. 5 and power supply 400 of FIG. 4 is that third resistor R3 554 is coupled between variable current circuit 522 and second terminal 528. In comparison, third resistor R3 454 of FIG. 4 is coupled between first terminal 426 and variable current circuit 422.

Similar to variable current circuit 422 of FIG. 4, variable current circuit 522 of FIG. 5 includes a first transistor Q1 550 having a first terminal coupled to the first terminal 526 of the bleeder circuit 504, a second terminal coupled to the second terminal 528 of the bleeder circuit 504, and a control terminal coupled to be responsive to the edge detection signal 524. In one example, variable current circuit 522 also includes a second transistor Q2 552 having a first terminal coupled to the first terminal of the first transistor Q1 550, a second terminal coupled to the control terminal of the first transistor Q1 550, and a control terminal coupled to receive the edge detection signal 524 from the edge detection circuit 520. As shown in the example depicted in FIG. 5, the first and second transistors Q1 550 and Q2 552 are bipolar transistors, which provide a Darlington pair coupled between the first and second terminals 526 and 528 and coupled to be responsive to the edge detection signal 524.

It is appreciated in an example in which third resistor R3 554 coupled to the emitter of first transistor Q1 550, first and second transistors Q1 550 and Q2 552 may be operated in the saturation region as a switch in response to edge detection signal 524, such that the bleeder current $I_B$ 515 determined in response to the resistance value of third resistor R3 554 in accordance with the teachings of the invention.

Figure 6:
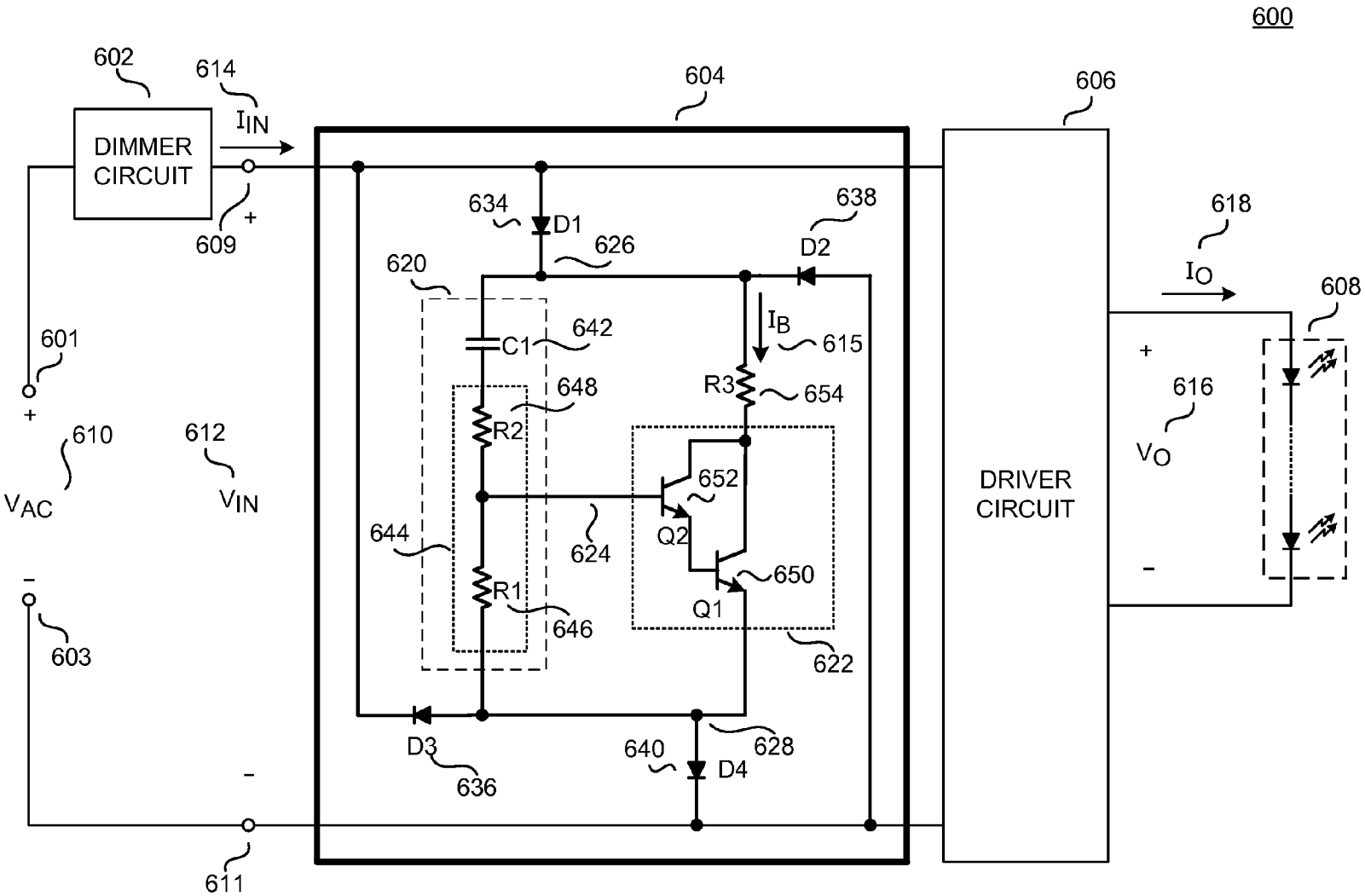
FIG. 6 is a functional block diagram of an example of a power supply included in a lighting system including still another example bleeder circuit in accordance with the teachings of the present invention.

FIG. 6 is a functional block diagram of an example of a power supply 600 included in a lighting system including still another example bleeder circuit 604 in accordance with the teachings of the present invention. It is appreciated that example power supply 600 of FIG. 6 also shares many similarities with power supply 400 of FIG. 4. For instance, power supply 600 includes a driver circuit 606 that is coupled to drive a load 608 with an output voltage $V_O$ 616 and an output current $I_O$ 618. In the depicted example, driver circuit 606 is coupled to first input 609 and second input 611 to receive the input signal $V_{IN}$ 612 and an input current $I_{IN}$ 614.

As shown in the depicted example, power supply 600 also includes bleeder circuit 604, which includes a first terminal 626 to be coupled to a first input 609 of power supply 600. Bleeder circuit 604 also includes a second terminal 628 to be coupled to a second input 611 of power supply 600. Bleeder circuit 604 may be implemented as a monolithic integrated circuit or may be implemented with discrete electrical components or a combination of discrete and integrated components. Further, bleeder circuit 604 is a bidirectional bleeder circuit. An edge detection circuit 620 is coupled between first and second terminals 626 and 628 of bleeder circuit 604. In one example, edge detection circuit 620 is coupled to output an edge detection signal 624 in response to a high frequency transition sensed in input signal $V_{IN}$ 612. A variable current circuit 622 is coupled to edge detection circuit 620 and coupled between first and second terminals 626 and 628 of bleeder circuit 604. Variable current circuit 622 is coupled to conduct a bleeder current $I_B$ 615 between first and second terminals 626 and 628 of bleeder circuit 604 in response to the edge detection signal 624 in accordance with the teachings of the present invention.

In one example, edge detection circuit 620 includes a high pass filter coupled between the first and second terminals 626 and 628 of the bleeder circuit 604. In the example depicted in FIG. 6, the edge detection circuit 620 includes a capacitance 642 and a resistance 644 coupled between the first and second terminals 626 and 628 of the bleeder circuit 504. In one example, the resistance 644 includes a resistor divider including a first resistor R1 646 and a second resistor R2 648 coupled between the capacitance 642 and the second terminal 628. In the example, the edge detection signal 624 is output from a node between the first resistor R1 646 and the second resistor R2 648.

In one example, variable current circuit 622 includes a current amplifier circuit having an input coupled to receive the edge detection signal 624 to conduct bleeder current $I_B$ 615 between first terminal 626 and second terminal 628 in accordance with the teachings of the present invention. In one example, a third resistor R3 654 is included and is coupled to the variable current circuit 622 and coupled between the first and second terminals 626 and 628 of the bleeder circuit 604 as shown. However, third resistor R3 654 may be optional.

In one example, variable current circuit 622 includes a first transistor Q1 650 having a first terminal coupled to the first terminal 626 of the bleeder circuit 604, a second terminal coupled to the second terminal 628 of the bleeder circuit 604, and a control terminal coupled to be responsive to the edge detection signal 624. In one example, variable current circuit 622 also includes a second transistor Q2 652 having a first terminal coupled to the first terminal of the first transistor Q1 650, a second terminal coupled to the control terminal of the first transistor Q1 650, and a control terminal coupled to receive the edge detection signal 624 from the edge detection circuit 620. As shown in the example depicted in FIG. 6, the first and second transistors Q1 650 and Q2 652 are bipolar transistors, which provide a Darlington pair coupled between the first and second terminals 626 and 628 and coupled to be responsive to the edge detection signal 624.

One difference between power supply 600 of FIG. 6 and power supply 400 of FIG. 4 is that a rectifier is included in bleeder circuit 604 as shown. In particular, a first diode 634 is coupled between first input 609 of power supply 600 and first terminal 626 of the bleeder circuit 604. A second diode 638 is coupled between the second input 611 of the power supply 600 and first terminal 626 of bleeder circuit 604. A third diode 636 is coupled between first input 609 of the power supply 600 and second terminal 628 of bleeder circuit 604. A fourth diode 640 is coupled between second input 611 of the power supply 600 and second terminal 628 of the bleeder circuit 604. In operation, first diode 634, second diode 638, third diode 636 and fourth diode 640 are coupled as shown to provide a rectified input signal $V_{IN}$ 612 to edge detection circuit 620 and to variable current circuit 622 in accordance with the teachings of the present invention. Accordingly, in the depicted example, bleeder circuit 604 is a bidirectional bleeder circuit can provide bleeder current $I_B$ 615 for power supply 600 whether or not a separate rectifier is included in power supply 600 in accordance with the teachings of the present invention.

Figure 7:
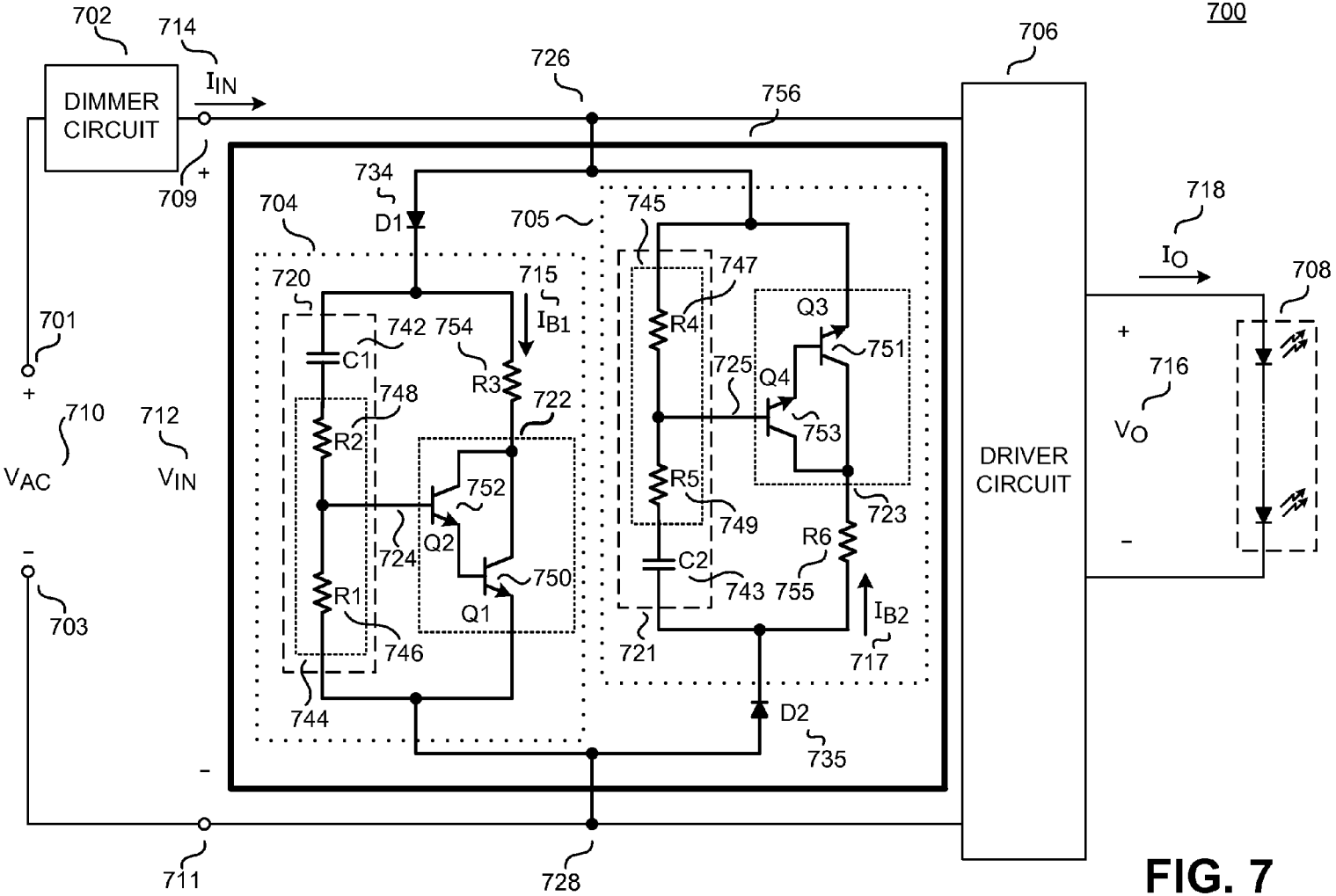
FIG. 7 is a functional block diagram of one example of a power supply included in a lighting system including an example bidirectional bleeder circuit in accordance with the teachings of the present invention.

FIG. 7 is a functional block diagram of one example of a power supply 700 included in a lighting system including an example bidirectional bleeder circuit 756 in accordance with the teachings of the present invention.

It will be appreciated below, it is noted that example power supply 700 of FIG. 7 shares many similarities with power supply 400 of FIG. 4, except that bidirectional bleeder circuit 756 of power supply 700 includes two replica bleeder circuits that are similar to the bleeder circuit 404 of FIG. 4. For instance, as shown in the depicted example, power supply 700 includes a driver circuit 706 that is coupled to drive a load 708 with an output voltage $V_O$ 716 and an output current $I_O$ 718. In the depicted example, driver circuit 706 is coupled to first input 709 and second input 711 to receive the input signal $V_{IN}$ 712 and input current $I_{IN}$ 714.

As shown in the depicted example, power supply 700 also includes an example bidirectional bleeder circuit 756, which includes a first terminal 726 coupled to first input 709 of the power supply 700 and a second terminal 728 coupled to second input 711 of the power supply 700. In one example, bidirectional bleeder circuit 756 includes a first bleeder circuit 704, which includes a first edge detection circuit 720 and a first variable current circuit 722, and a second bleeder circuit 705, which includes a second edge detection circuit 721 and a second variable current circuit 723, as shown. Bidirectional bleeder circuit 756 may be implemented as a monolithic integrated circuit or may be implemented with discrete electrical components or a combination of discrete and integrated components.

In particular, as shown in the depicted example, first edge detection circuit 720 is coupled between the first and second terminals 726 and 728 of the bleeder circuit 756. First edge detection circuit 720 is coupled to output a first edge detection signal 724 in response to a high frequency transition sensed in input signal $V_{IN}$ 712 between the first and second inputs 709 and 711 of the power supply 700 having a first polarity. In one example, the first polarity is a positive polarity. First variable current circuit 722 is coupled to first edge detection circuit 720 and is coupled between the first and second terminals 726 and 728 of the bleeder circuit 756. First variable current circuit 722 is coupled to conduct a first bleeder current $I_{B1}$ 715 in a first direction between the first and second terminals 726 and 728 of the bleeder circuit 756 in response to the first edge detection signal 724. In one example, the first direction that first bleeder current $I_{B1}$ 715 is conducted through variable current circuit 722 is from first terminal 726 to second terminal 728.

Second edge detection circuit 721 is coupled between first and second terminals 726 and 728 of the bleeder circuit 756. Second edge detection 721 is coupled to output a second edge detection signal 725 in response to a high frequency transition sensed in input signal $V_{IN}$ 712 between first and second inputs 709 and 711 of the power supply 700 having a second polarity. In one example, the second polarity is a negative polarity. A second variable current circuit 723 is coupled to the second edge detection circuit 721 and is coupled between first and second terminals 726 and 728 of the bleeder circuit 756. The second variable current circuit 723 is coupled to conduct a second bleeder current $I_{B2}$ 717 in a second direction between the first and second terminals 726 and 728 of the bleeder circuit 756 in response to the second edge detection signal 725. In one example, the second direction that second bleeder current $I_{B2}$ 717 is conducted through variable current circuit 722 is from second terminal 728 to first terminal 726.

As shown in the example depicted in FIG. 7, bidirectional bleeder circuit 756 also includes a first diode 734 coupled to first edge detection circuit 720 and first variable current circuit 722 and is coupled between first and second terminals 726 and 728 of bleeder circuit 756. First diode 734 is coupled such that the first bleeder current $I_{B1}$ 715 conducts through the first variable current circuit 722 in response to the input signal $V_{IN}$ 712 having the first polarity. A second diode 735 is coupled to second edge detection circuit 721 and second variable current circuit 723 and is coupled between the first and second terminals 726 and 728 of the bleeder circuit 756. Second diode 735 is coupled such that second bleeder current $I_{B2}$ 717 conducts through second variable current circuit 723 in response to the input signal $V_{IN}$ 712 having the second polarity.

As shown in the depicted example, each one of the first and second edge detection circuits 720 and 721 includes a respective one of first and second high pass filters coupled between the first and second terminals 726 and 728 of the bleeder circuit 756 to generate a respective one of the first and second edge detection signals 724 and 725 in response to a high frequency transition sensed in input signal $V_{IN}$ 712 between the first and second inputs 709 and 711 of the power supply 700. As shown, each one of the first and second high pass filters includes a respective one of first and second capacitances 742 and 743, coupled to a respective one of first and second resistances 744 and 745 as RC circuits, similar to the high pass filter examples provided in edge detection circuits 420, 520 and 620 described previously in FIGS. 4, 5 and 6, respectively, in accordance with the teachings of the present invention.

As shown in the depicted example, each one of the first and second variable current circuits 722 and 723 includes a respective one of first and second current amplifier circuits coupled to receive a respective one of first and second edge detection signals 724 and 725 to conduct a respective one of first and second bleeder currents $I_{B1}$ 715 and $I_{B2}$ 717 in response to the respective one of the first and second edge detection signals 724 and 725 in accordance with teachings of the present invention. As shown in the depicted example, each one of the first and second current amplifier circuits includes a respective one of first and second Darlington pairs including transistors Q1 750 and Q2 752, as well as transistors Q3 751 and Q4 753, similar to the current amplifier circuit examples provided in the variable current circuits 422, 522 and 622 described previously in FIGS. 4, 5 and 6, respectively, in accordance with the teachings of the present invention.

As shown in the depicted example, a resistor R3 754 is also included in bleeder circuit 704 and is coupled to variable current circuit 722 and is coupled to first terminal 726 through first diode 734 of bidirectional bleeder circuit 756 as shown. Similarly, a resistor R6 755 is also included in bleeder circuit 705 and is coupled to variable current circuit 723 and second terminal 728 through second diode 735 of bidirectional bleeder circuit 756 as shown. However, resistor R3 754 and R6 755 may be optional.

Figure 8:
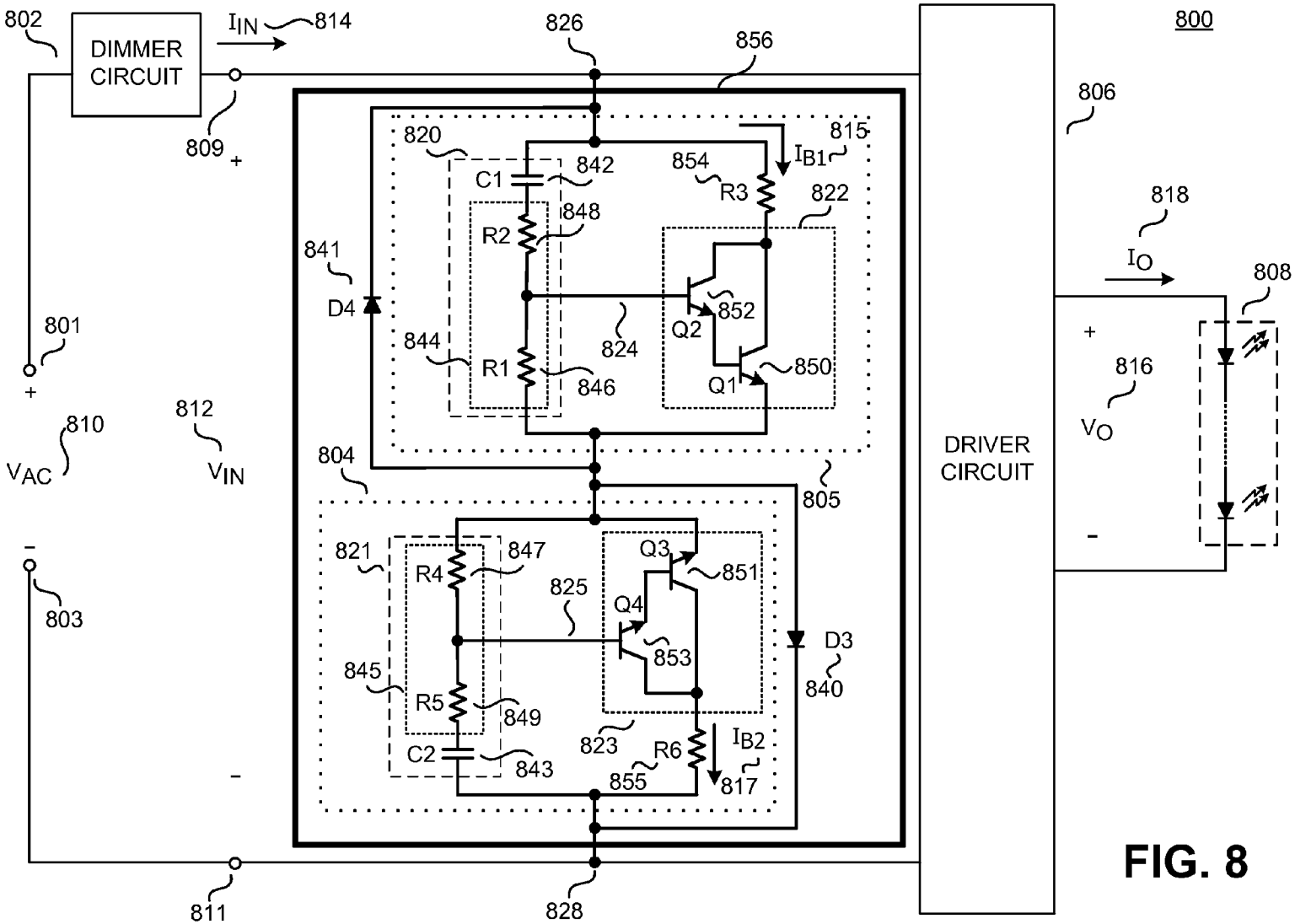
FIG. 8 is a functional block diagram of one example of a power supply included in a lighting system including another example bidirectional bleeder circuit in accordance with the teachings of the present invention.

FIG. 8 is a functional block diagram of one example of a power supply 800 included in a lighting system including another example bidirectional bleeder circuit 856 in accordance with the teachings of the present invention. It is appreciated that example power supply 800 of FIG. 8 shares many similarities with power supply 700 of FIG. 7. For instance, power supply 800 includes a driver circuit 806 that is coupled to drive a load 808 with an output voltage $V_O$ 816 and an output current $I_O$ 818. In the depicted example, driver circuit 806 is coupled to first input 809 and second input 811 to receive the input signal $V_{IN}$ 812 and input current $I_{IN}$ 814.

As shown in the depicted example, power supply 800 also includes another example of a bidirectional bleeder circuit 856, which includes a first terminal 826 coupled to first input 809 of the power supply 800 and a second terminal 828 coupled to second input 811 of the power supply 800. In one example, bidirectional bleeder circuit 856 includes a first bleeder circuit 804, which includes a first edge detection circuit 820 and a first variable current circuit 822, and a second bleeder circuit 805, which includes a second edge detection circuit 821 and a second variable current circuit 823, as shown. Bidirectional bleeder circuit 856 may be implemented as a monolithic integrated circuit or may be implemented with discrete electrical components or a combination of discrete and integrated components.

In particular, as shown in the depicted example, first edge detection circuit 820 is coupled between the first and second terminals 826 and 828 of the bleeder circuit 856. First edge detection circuit 820 is coupled to output a first edge detection signal 824 in response to a high frequency transition sensed in input signal $V_{IN}$ 812 between the first and second inputs 809 and 811 of the power supply 800 having a first polarity. First variable current circuit 822 is coupled to first edge detection circuit 820 and is coupled between the first and second terminals 826 and 828 of the bleeder circuit 856. First variable current circuit 822 is coupled to conduct a first bleeder current $I_{B1}$ 815 in a first direction between the first and second terminals 826 and 828 of the bleeder circuit 856 in response to the first edge detection signal 824.

Second edge detection circuit 821 is coupled between first and second terminals 826 and 828 of the bleeder circuit 856. Second edge detection circuit 821 is coupled to output a second edge detection signal 825 in response to a high frequency transition sensed in input signal $V_{IN}$ 812 between first and second inputs 809 and 811 of the power supply 800 having a second polarity. A second variable current circuit 823 is coupled to second edge detection circuit 821 and is coupled between first and second terminals 826 and 828 of the bleeder circuit 856. The second variable current circuit 823 is coupled to conduct a second bleeder current $I_{B2}$ 817 in a second direction between the first and second terminals 826 and 828 of the bleeder circuit 856 in response to the second edge detection signal 825.

One difference between power supply 800 of FIG. 8 and power supply 700 of FIG. 7 is that bidirectional bleeder circuit 856 of FIG. 8 includes a first diode 840 coupled to first edge detection circuit 820 and first variable current circuit 822 and is coupled to second terminal 828 of bidirectional bleeder circuit 856 as shown such that the first bleeder current $I_{B1}$ 815 is conducted through the first variable current circuit 822 in response to the input signal $V_{IN}$ 812 having the first polarity. In contrast, bidirectional bleeder circuit 756 of FIG. 7 includes first diode 734 coupled to first edge detection circuit 720 and first variable current circuit 722 and is coupled to first terminal 726 of bleeder circuit 756 such that the first bleeder current $I_{B1}$ 715 is conducted through first variable current circuit 722 in response to the input signal $V_{IN}$ 710 having the first polarity as shown.

In addition, referring back to power supply 800 of FIG. 8, a second diode 841 is coupled to second edge detection circuit 821 and second variable current circuit 823 and is coupled to first terminal 826 of bleeder circuit 856 such that the second bleeder current $I_{B2}$ 817 is conducted through second variable current circuit 823 in response to the input signal $V_{IN}$ 810 having the second polarity. In contrast, bidirectional bleeder circuit 756 of FIG. 7 includes second diode 735 coupled to second edge detection circuit 721 and second variable current circuit 723 and is coupled to second terminal 728 of bleeder circuit 756 such that the second bleeder current $I_{B2}$ 717 is conducted through second variable current circuit 723 in response to the input signal 710 having the second polarity as shown.

As shown in the depicted example, each one of the first and second edge detection circuits 820 and 821 includes a respective one of first and second high pass filters coupled between the first and second terminals 826 and 828 of the bleeder circuit 856 to generate a respective one of the first and second edge detection signals 824 and 825 in response to a high frequency transition sensed in input signal $V_{IN}$ 812 between the first and second inputs 809 and 811 of the power supply 800. As shown, each one of the first and second high pass filters includes a respective one of first and second capacitances 842 and 843, coupled to a respective one of first and second resistances 844 and 845 to provide RC circuits, similar to the high pass filter examples provided in edge detection circuits 420, 520, 620, 720 and 721 described previously in FIGS. 4, 5, 6 and 7, respectively, in accordance with the teachings of the present invention.

As shown in the depicted example, each one of the first and second variable current circuits 822 and 823 includes a respective one of first and second current amplifier circuits coupled to receive a respective one of first and second edge detection signals 824 and 825 to conduct a respective one of first and second bleeder currents $I_{B1}$ 815 and $I_{B2}$ 817 in response to the respective one of the first and second edge detection signals 824 and 825 in accordance with teachings of the present invention. As shown in the depicted example, each one of the first and second current amplifier circuits includes a respective one of first and second Darlington pairs including transistors Q1 850 and Q2 852, as well as transistors Q3 851 and Q4 853, similar to the current amplifier circuit examples provided in the variable current circuits 422, 522, 622, 722 and 723 described previously in FIGS. 4, 5, 6 and 7, respectively, in accordance with the teachings of the present invention.

As shown in the depicted example, a resistor R3 854 is also included in bleeder circuit 804 and is coupled to first variable current circuit 822 and first terminal 826 of bidirectional bleeder circuit 856 as shown. Similarly, a resistor R6 855 is also included in bleeder circuit 805 and is coupled to second variable current circuit 823 and second terminal 828 of bidirectional bleeder circuit 856 as shown.

Figure 9:
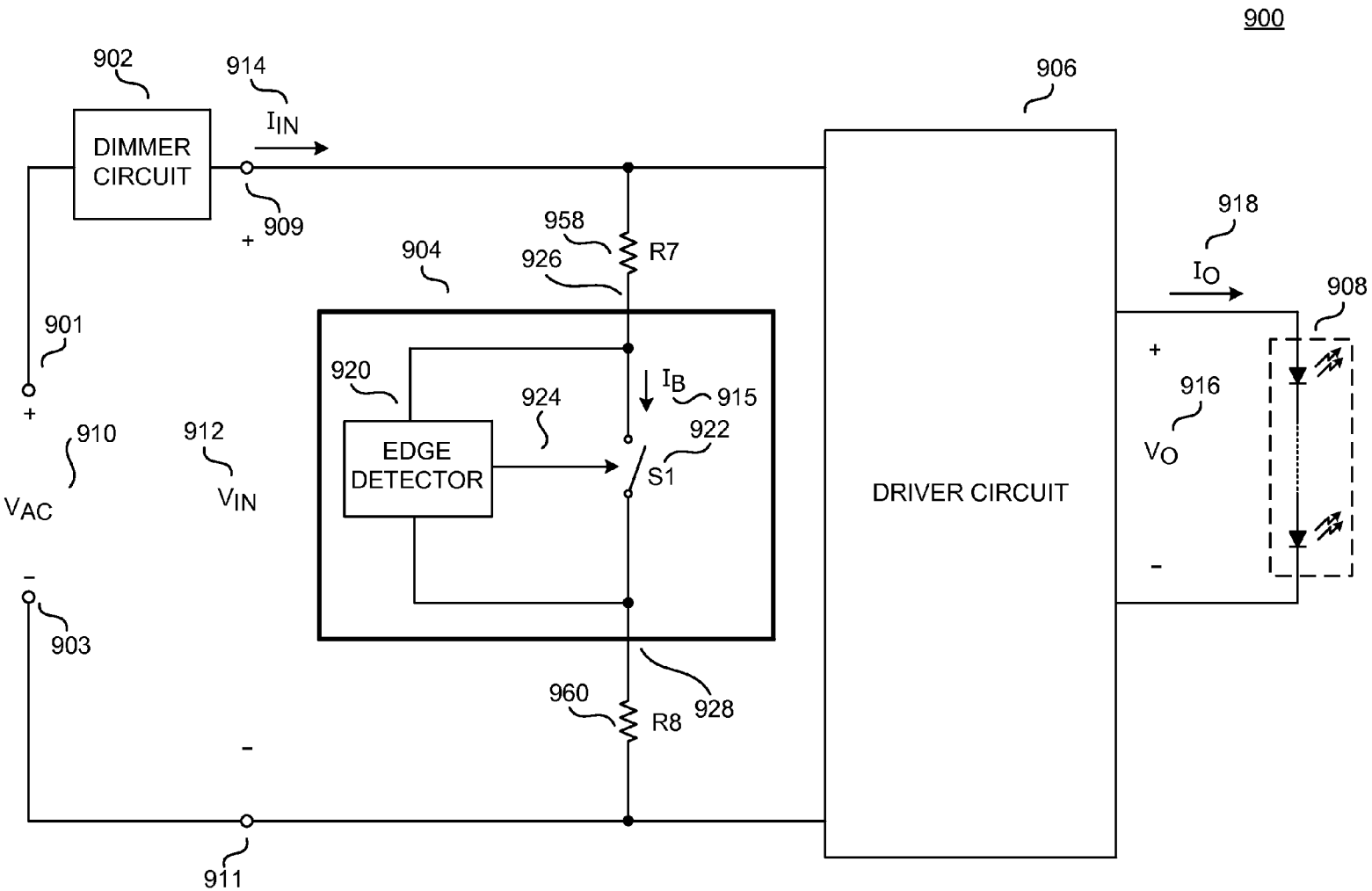
FIG. 9 is a functional block diagram of one example of a power supply included in a lighting system including yet another example bleeder circuit in accordance with the teachings of the present invention.

FIG. 9 is a functional block diagram of one example of a power supply 900 included in a lighting system including yet another example bleeder circuit 904 in accordance with the teachings of the present invention. It is appreciated that example power supply 900 of FIG. 9 shares many similarities with power supply 100 of FIG. 1. For instance, power supply 900 includes a driver circuit 906 that is coupled to drive a load 908 with an output voltage $V_O$ 916 and an output current $I_O$ 918. In the depicted example, driver circuit 906 is coupled to first input 909 and second input 911 to receive the input signal $V_{IN}$ 912 and input current $I_{IN}$ 914.

As shown in the depicted example, power supply 900 also includes bleeder circuit 904, which includes a first terminal 926 to be coupled to first input 909 of power supply 900. Bleeder circuit 904 also includes a second terminal 928 to be coupled to a second input 911 of power supply 900. An edge detection circuit 920 is coupled between first and second terminals 926 and 928 of bleeder circuit 904. In one example, edge detection circuit 920 is coupled to output an edge detection signal 924 in response to a high frequency transition sensed in input signal $V_{IN}$ 912.

One difference between power supply 900 of FIG. 9 and power supply 100 of FIG. 1 is that in the example depicted in FIG. 9, a variable current circuit 922, which is illustrated in the example as a switch S1, is coupled to edge detection circuit 920 and is coupled between first and second terminals 926 and 928 of bleeder circuit 904. In the example, switch S1 of variable current circuit 922 is coupled to conduct a bleeder current $I_B$ 915 between first and second terminals 926 and 928 of bleeder circuit 904 in response to the edge detection signal 924 in accordance with the teachings of the present invention. In one example, edge detection signal is a voltage and switch S1 922 may be either in an ON state or an OFF state. It should be appreciated that a switch that is OFF (i.e. open) cannot conduct current while a switch that is ON (i.e. closed) may conduct current.

Another difference between power supply 900 of FIG. 9 and power supply 100 of FIG. 1 is that in the example depicted in FIG. 9, a resistor R7 958 is coupled between first terminal 926 of bleeder circuit 904 and first input 909 of power supply 900. In addition, in one example, a resistor R8 960 is coupled between second terminal 928 of bleeder circuit 904 and second input 911 of power supply 900. As shown in the depicted example, resistor R7 958 and resistor R8 960 are external to bleeder circuit 904. In one example, the magnitude of bleeder current $I_B$ 915 when switch S1 is ON is responsive to the resistance values of resistor R7 958 and resistor R8 960.

The above description of illustrated examples of the present invention, including what is described in the Abstract, are not intended to be exhaustive or to be limitation to the precise forms disclosed. While specific embodiments of, and examples for, the invention are described herein for illustrative purposes, various equivalent modifications are possible without departing from the broader spirit and scope of the present invention. Indeed, it is appreciated that the specific example voltages, currents, frequencies, power range values, times, etc., are provided for explanation purposes and that other values may also be employed in other embodiments and examples in accordance with the teachings of the present invention.

What is claimed is:

1. A bleeder circuit for use in a power supply of a lighting system, comprising:

a first terminal to be coupled to a first input of the power supply;

a second terminal to be coupled to a second input of the power supply;

an edge detection circuit coupled between the first and second terminals of the bleeder circuit, the edge detection circuit coupled to output an edge detection signal indicating a high frequency transition in an input signal between the first and second inputs, wherein the edge detection circuit comprises a high pass filter coupled between the first and second terminals of the bleeder circuit, wherein the high pass filter includes an output coupled to generate the edge detection signal indicating the high frequency transition in the input signal between the first and second inputs of the power supply; and a variable current circuit coupled to the edge detection circuit and coupled between the first and second terminals of the bleeder circuit, the variable current circuit coupled to conduct a bleeder current between the first and second terminals of the bleeder circuit in response to the edge detection signal, wherein the variable current circuit is coupled to continue conducting the bleeder current between the first and second terminals of the bleeder circuit until an end of a half line cycle of the input signal.

2. The bleeder circuit of claim 1 wherein the edge detection circuit comprises a capacitance and a resistance coupled between the first and second terminals of the bleeder circuit, wherein the edge detection signal is output from the resistance.

3. The bleeder circuit of claim 1 wherein the edge detection circuit comprises a capacitance and a resistance coupled between the first and second terminals of the bleeder circuit, wherein the resistance comprises a first resistor and a second resistor coupled between the capacitance and the second terminal, wherein the edge detection signal is output from a node between the first resistor and the second resistor.

4. The bleeder circuit of claim 1 wherein the variable current circuit comprises a current amplifier circuit having an input coupled to receive the edge detection signal, the current amplifier circuit coupled between the first and second terminals to conduct the bleeder current in response to the edge detection signal.

5. The bleeder circuit of claim 1 wherein the variable current circuit comprises a first transistor having a first terminal coupled to the first terminal of the bleeder circuit, a second terminal coupled to the second terminal of the bleeder circuit, and a control terminal coupled to be responsive to the edge detection signal.

6. The bleeder circuit of claim 1 wherein the variable current circuit comprises:

a first transistor having a first terminal coupled to the first terminal of the bleeder circuit, a second terminal coupled to the second terminal of the bleeder circuit, and a control terminal; and a second transistor having a first terminal coupled to the first terminal of the first transistor, a second terminal coupled to the control terminal of the first transistor, and a control terminal coupled to receive the edge detection signal from the edge detection circuit.

7. The bleeder circuit of claim 6 wherein the first and second transistors are bipolar transistors, and wherein the first and second transistors are included in a Darlington pair coupled between the first and second terminals and coupled to be responsive to the edge detection signal.

8. The bleeder circuit of claim 1 wherein the variable current circuit comprises a switch having a first terminal coupled to the first terminal of the bleeder circuit, a second terminal coupled to the second terminal of the bleeder circuit, and a control terminal coupled to be responsive to the edge detection circuit.

9. The bleeder circuit of claim 1 further comprising a third resistor coupled to the variable current circuit and coupled between the first and second terminals of the bleeder circuit.

10. The bleeder circuit of claim 1 further comprising a rectifier circuit, wherein the rectifier circuit comprises:

a first diode coupled between the first input of the power supply and the first terminal of the bleeder circuit;

a second diode coupled between the second input of the power supply and the first terminal of the bleeder circuit;

a third diode coupled between the first input of the power supply and the second terminal of the bleeder circuit; and a fourth diode coupled between the second input of the power supply and the second terminal of the bleeder circuit.

11. The bleeder circuit of claim 1 wherein the edge detection signal is a current, and wherein the bleeder current is an amplified representation of the edge detection signal.

12. The bleeder circuit of claim 1 wherein the input signal comprises an input voltage to be received by the power supply from a dimmer circuit.

13. A bleeder circuit for use in a power supply of a lighting system, comprising:

a first terminal to be coupled to a first input of the power supply;

a second terminal to be coupled to a second input of the power supply;

a first edge detection circuit coupled between the first and second terminals of the bleeder circuit, the first edge detection coupled to output a first edge detection signal indicating a high frequency transition in an input signal between the first and second inputs of the power supply having a first polarity;

a first variable current circuit coupled to the first edge detection circuit and coupled between the first and second terminals of the bleeder circuit, the first variable current circuit coupled to conduct a first bleeder current in a first direction between the first and second terminals of the bleeder circuit in response to the first edge detection signal;

a second edge detection circuit coupled between the first and second terminals of the bleeder circuit, the second edge detection coupled to output a second edge detection signal indicating the high frequency transition in the input signal between the first and second inputs of the power supply having a second polarity; and a second variable current circuit coupled to the second edge detection circuit and coupled between the first and second terminals of the bleeder circuit, the second variable current circuit coupled to conduct a second bleeder current in a second direction between the first and second terminals of the bleeder circuit in response to the second edge detection signal.

14. The bleeder circuit of claim 13 further comprising:

a first diode coupled to the first edge detection circuit and the first variable current circuit and coupled between the first and second terminals of the bleeder circuit, wherein the first diode is coupled to conduct the first bleeder current through the first variable current circuit in response to the input signal having the first polarity; and a second diode coupled to the second edge detection circuit and the second variable current circuit and coupled between the first and second terminals of the bleeder circuit, wherein the second diode is coupled to conduct the second bleeder current through the second variable current circuit in response to the input signal having the second polarity.

15. The bleeder circuit of claim 13 wherein each one of the first and second edge detection circuits comprises a respective one of first and second high pass filters coupled between the first and second terminals of the bleeder circuit to generate a respective one of the first and second edge detection signals indicating the high frequency transition in the input signal between the first and second inputs of the power supply.

16. The bleeder circuit of claim 13 wherein each one of the first and second variable current circuits comprises a respective one of first and second current amplifier circuits coupled to receive a respective one of the first and second edge detection signals to conduct a respective one of the first and second bleeder currents in response to the respective one of the first and second edge detection signals.

17. A power supply for use in a lighting system, comprising:

first and second inputs coupled to receive an input signal;

a driver circuit coupled to receive the input signal from the first and second inputs to drive a load coupled to an output of the driver circuit; and a bleeder circuit coupled between the first and second inputs and to the driver circuit, the bleeder circuit comprising:

first and second terminals coupled to receive the input signal from the first and second inputs of the power supply;

an edge detection circuit coupled between the first and second terminals of the bleeder circuit, the edge detection circuit coupled to output an edge detection signal indicating a high frequency transition in the input signal between the first and second inputs, wherein the edge detection circuit comprises a high pass filter coupled between the first and second terminals of the bleeder circuit, wherein the high pass filter includes an output coupled to generate the edge detection signal indicating the high frequency transition in the input signal between the first and second inputs of the power supply; and a variable current circuit coupled to the edge detection circuit and coupled between the first and second terminals of the bleeder circuit, the variable current circuit coupled to conduct a bleeder current between the first and second terminals of the bleeder circuit in response to the edge detection signal, wherein the variable current circuit is coupled to continue conducting the bleeder current between the first and second terminals of the bleeder circuit until an end of a half line cycle of the input signal.

18. The power supply of claim 17, wherein the input signal comprises an input voltage received by the power supply from a thyristor circuit coupled to add the high frequency transition to half line cycles of the input signal.

19. The power supply of claim 17 further comprising a rectifier coupled between first and second inputs of the power supply.

20. The power supply of claim 17 wherein the edge detection circuit comprises a capacitance and a resistance coupled between the first and second terminals of the bleeder circuit, wherein the edge detection signal is output from the resistance.

21. The power supply of claim 17 wherein the variable current circuit comprises a current amplifier circuit having an input coupled to receive the edge detection signal, the current amplifier circuit coupled between the first and second terminals to conduct the bleeder current in response to the edge detection signal.

22. The power supply of claim 17 wherein the variable current circuit comprises a first transistor having a first terminal coupled to the first terminal of the bleeder circuit, a second terminal coupled to the second terminal of the bleeder circuit, and a control terminal coupled to be responsive to the edge detection signal.

23. The power supply of claim 17 wherein the variable current circuit comprises:

a first transistor having a first terminal coupled to the first terminal of the bleeder circuit, a second terminal coupled to the second terminal of the bleeder circuit, and a control terminal; and a second transistor having a first terminal coupled to the first terminal of the first transistor, a second terminal coupled to the control terminal of the first transistor, and a control terminal coupled to receive the edge detection signal from the edge detection circuit.

24. The power supply of claim 23 wherein the first and second transistors are bipolar transistors, and wherein the first and second transistors are included in a Darlington pair coupled between the first and second terminals and coupled to be responsive to the edge detection signal.

25. The power supply of claim 17 wherein the load comprises a light emitting diode lamp.

* * * * *